239-585.4 SR

H1329 OR 4,423,842

United States Patent [19]

Palma

[11] 4,423,842

[45] Jan. 3, 1984

[54] ELECTROMAGNETIC FUEL INJECTOR WITH SELF ALIGNED ARMATURE

[75] Inventor: James D. Palma, Grand Rapids, Mich.

[73] Assignee: General Motors Corporation, Detroit, Mich.

[21] Appl. No.: 351,964

[22] Filed: Feb. 24, 1982

[51] Int. Cl.[3] ..... F02M 51/06

[52] U.S. Cl. ..... 239/585; 251/129; 251/141

[58] Field of Search ..... 239/584, 585, 600; 251/129, 141

[56] References Cited

U.S. PATENT DOCUMENTS

| | | | |
|---|---|---|---|
| 2,639,193 | 5/1953 | Wood, Jr. | 239/584 |
| 3,434,667 | 3/1969 | Chmura | 239/584 |
| 3,738,578 | 6/1973 | Farrell | 239/585 |
| 3,797,756 | 3/1974 | Voit et al. | 239/585 |
| 4,218,021 | 8/1980 | Palma | 239/585 |
| 4,247,052 | 1/1981 | Gray | 239/585 |

*Primary Examiner*—John J. Love
*Assistant Examiner*—Michael J. Forman
*Attorney, Agent, or Firm*—Arthur N. Krein

[57] ABSTRACT

An electromagnetic fuel injector is provided with a one piece armature/valve member that is guided at its armature end by a guide washer and at its ball end by a guide means in the injection nozzle assembly of the injector, a spring applying a clamping force on these guide provision members to fix them within the nozzle body of the nozzle assembly.

3 Claims, 2 Drawing Figures

ELECTROMAGNETIC FUEL INJECTOR WITH SELF ALIGNED ARMATURE

FIELD OF THE INVENTION

This invention relates to electromagnetic fuel injectors and, in particular, to such an injector having a guide washer means therein to guide the armature end of an armature/valve member and another guide means to guide the valve end thereof.

This application is related to applicants' copending U.S. patent application Ser. No. 343,431 filed Jan. 28, 1982, and assigned to the assignee of the present invention.

DESCRIPTION OF THE PRIOR ART

Electromagnetic fuel injectors are used in fuel injection systems for vehicle engines because of the capability of this type injector to more effectively control the discharge of a precise metered quantity of fuel per unit of time to an engine. Such electromagnetic fuel injectors, as used in vehicle engines, are normally calibrated so as to inject a predetermined quantity of fuel per unit of time prior to their installation in the fuel system for a particular engine.

In one such type electromagnetic fuel injector as shown, for example, in U.S. Pat. No. 4,231,525 entitled "Electromagnetic Fuel Injector with Selectively Hardened Armature" issued Nov. 4, 1980 to James D. Palma, a two-part valve means movable relative to an annular valve seat is used to open and close a passage for the delivery of fuel from the injector out through an injection nozzle having delivery orifices downstream of the valve seat. One part of this valve means is a sphere-like valve member having a flat on one side thereof and being spherical opposite the flat to provide a spherical seating surface for valve closing engagement with the valve seat. The other part of the valve means is an armature with a flat end face seated against the flat surface of the valve member in a laterally slidable engagement therewith.

An armature spring is positioned within the injector to normally bias the armature in a direction to effect seating of the valve member against the valve seat. An air gap may be provided for in this type injector by the use of a stepped guide pin provided with a shoulder for abutment against a portion of the armature whereby to limit movement of the armature. A guide pin slidably received in the armature is used to guide the armature during reciprocating movement thereof.

Because of the use of this type guide pin, a two-part valve means as described hereinabove, was used in this type injector. Otherwise, if a one-piece armature-valve member is used in an injector with this type guide pin, close manufacturing tolerance must be maintained to insure concentricity of the valve seat with the guide pin and, it will be apparent that such close tolerance are normally not obtainable in mass production.

SUMMARY OF THE INVENTION

Accordingly, a primary object of the present invention is to provide an improved electromagnetic fuel injector construction that advantageously utilizes a guide washer and a second guide member for guiding the axial movement of a one piece armature/valve member in the direction toward and away from the working surface of an associate pole piece these members being aligned by the armature/valve member during assembly and maintained in alignment by means of a coiled spring within the injector.

Accordingly, another object of the invention is to provide an improved electromagnetic fuel injector having a guide washer member loosely received in the injector housing for abutment against a fixed surface and a valve seat, swirl director and spray tip in an injection nozzle tip assembly which is axially adjustable in the injector housing, an armature/valve member reciprocably guided by said elements and, a spring means biasing and fixing the guide washer member in spaced apart relationship to the valve seat.

Another object of this invention is to provide an improved electromagnetic fuel injector wherein an armature/valve member is reciprocably guided by a guide washer member and a guide means associated with the injection nozzle tip assembly of the injector for axial movement relative to an associate pole piece, at least one of the opposed surfaces of the armature/valve member and pole piece being crowned.

Still another object of this invention is to provide an injector apparatus of the above type which includes features of construction, operation and arrangement, rendering it easy to manufacture, assemble and to calibrate for desired fuel flow, which is reliable in operation, and in other respects suitable for use on production motor vehicle fuel systems.

The present invention provides an electromagnetic fuel injector having a housing with an injection nozzle assembly incorporated at one end thereof. An armature/valve member, in the form of an armature with a semi-spherical valve at one end thereof, is reciprocable relative to a pole piece to control flow through the fuel nozzle assembly. A guide washer member encircling the armature intermediate its end is positioned in the housing whereby to reciprocably guide one end of the armature/valve member. The injection nozzle assembly includes a valve seat element having a conical valve seat therein and a director plate supported by a spray tip which is axially adjustable in the housing. Preferably, the valve seat element is provided with an internal guide wall to slidably guide the outer peripheral surface of the valve and, in an alternate embodiment a guide post projects slidably into a guide bore in the valve, whereby the valve end of the armature/valve member is also guided for reciprocable movement. A spring loosely encircling the armature/valve member abuts at one end against the guide washer member and at its opposite end against the valve seat element to force the latter into abutment against the spray tip with the director plate sandwiched therebetween whereby these elements are fixed within the housing. In the preferred forms herein disclosed, a stop member with a crowned stop surface is fixed in the associate pole piece to serve as a stop to limit travel of the armature/valve member toward the pole piece whereby to provide for a fixed minimum air gap therebetween.

For a better understanding of the invention, as well as other objects and features thereof, reference is had to the following detailed description of the invention to be read with the accompanying drawings.

DESCRIPTION OF THE EMBODIMENTS

Figure 1:
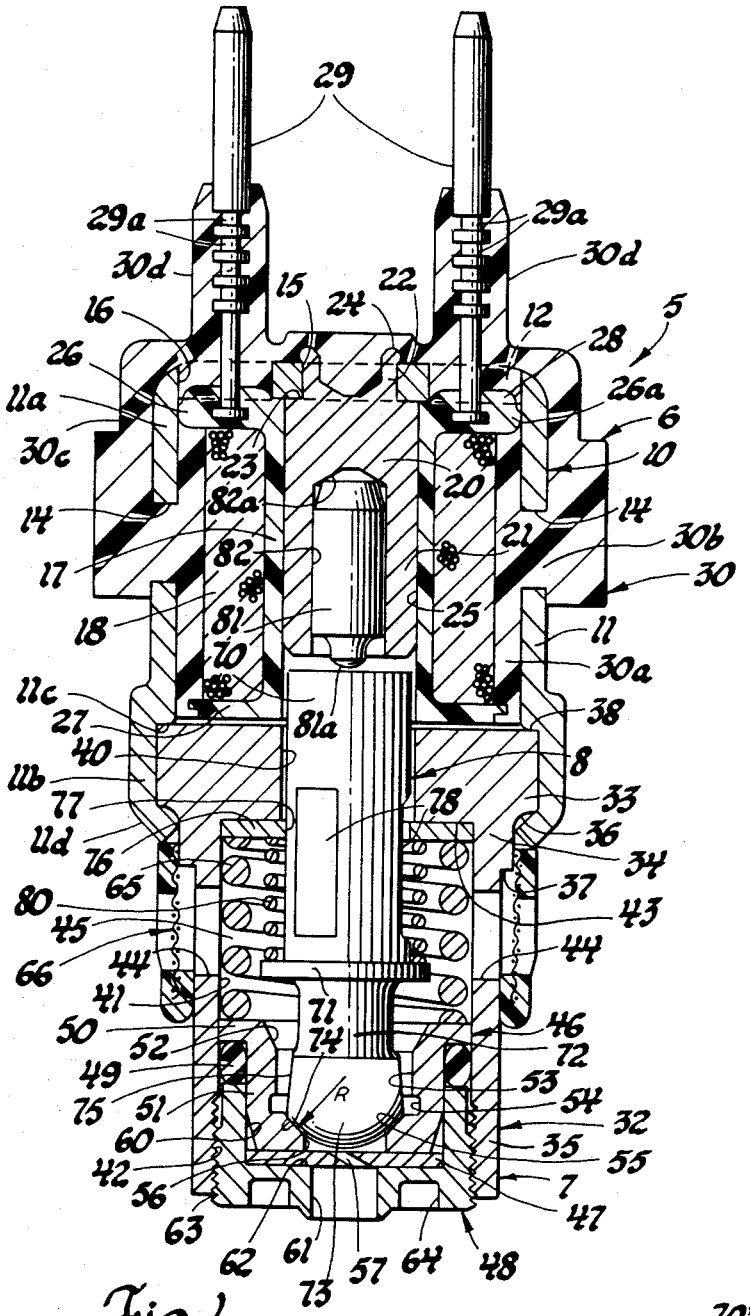
FIG. 1 is a longitudinal, cross-sectional view of a preferred embodiment of an electromagnetic fuel injector in accordance with the invention, the pole stop member and armature/valve member being shown in elevation; and, FIG. 2 is a longitudinal, cross-sectional view of a portion of the spray tip end of an alternate embodiment of an electromagnetic fuel injector in accordance with the invention, only the spray tip end of the injector being shown, the remaining portions, not shown, being similar to that of FIG. 1.

Referring first to FIG. 1, the preferred embodiment of the electromagnetic fuel injector, generally designated 5, illustrated therein includes, as major components thereof, a solenoid assembly 6, a nozzle assembly 7 and an armature/valve member 8.

The solenoid assembly 6 includes a cup-shaped, solenoid housing 10, made for example of SAE 1008-1010 steel, having a rim like, circular body 11 and an integral flange 12 extending radially inward from the upper end of body portion 11. Body 11 is provided with a plurality of circumferentially spaced apart apertures 14 located intermediate its ends. As shown, body portion 11 includes an upper portion 11*a* and a lower portion 11*b*, having both a greater internal diameter and a greater external diameter than the respective diameters of upper portion 11*a*, and an inter-internal flat shoulder 11*c*.

The flange 12 is provided with a central aperture 15 and with plural apertures 16, only two such apertures being seen in FIG. 1, that are circumferentially equally spaced apart and located radially outward, a predetermined distance, from the central aperture 15, all for a purpose to be described hereinafter. Preferably, at least two diametrically opposite apertures 16 are of arcuate configuration for a purpose also to be described in detail hereinafter.

Solenoid assembly 6 further includes a cylindrical pole piece 20 and a spool-like, tubular bobbin 17 supporting a wound wire solenoid coil 18. In the construction illustrated, pole piece 20 is provided with a cylindrical lower portion 21 of predetermined diameter, a cylindrical upper portion 22 of a reduced diameter corresponding to the internal diameter of aperture 15 and an interconnecting flat shoulder 23.

The pole piece 20 is fixed to the solenoid housing as by having the portion 22 of the pole piece 20 extending through the aperture 15, with the upper blind bored end of portion 22 crimped or swaged over so as to define a retention flange 24 whereby the material of the flange portion 12 of the solenoid housing 10 adjacent to aperture 15 is sandwiched between the shoulder 23 and the retention flange 24.

The bobbin 17, made, for example, of a suitable plastic material such as glass filled nylon, is provided with a central through bore 25 of a diameter to receive the lower portion 21 of pole piece 20, as by a press fit engagement therewith, whereby the bobbin 17 is supported concentrically within the solenoid housing 10 and with the upper flange 26 thereof in abutment against the inside surface of the flange portion 12 of the solenoid housing 10.

In the construction shown, both the upper flange 26 and bottom flange 27 of bobbin 17 are of similar external configuration with each including a main flange portion having at least three or more circumferentially spaced apart, radially outward extending lobes, such as lobes 26*a* on flange 26, formed integral therewith. Preferably, the major diameter of each flange, as defined by the outer peripheral edges of the lobes is selected relative to the inside diameter of the wall 11*a* of the solenoid housing 10 whereby the bobbin will be slidably received in this portion of the solenoid housing.

The minor diameter of each of the flanges 26 and 27, as defined by the outer peripheral edge of the main flange portion of each such flange is such so as to provide for radial clearance between it and the interior of wall 11*a* of the solenoid housing 10 for the passage of the encapsulant material of the encapsulant member 30 to be described hereinafter. Preferably, as shown with reference to FIG. 1, for example, the minor diameter of the flanges, and in particular of the upper flange 26 and the radial location of the apertures 16 are preselected to allow for the passage of encapsulant material around the outer peripheral edge of the main flange portion of upper flange 26 and through the apertures 16 for a purpose to be described hereinafter.

Bobbin 17 is also provided with a pair of diametrically opposed upright terminal leads 29, which project upward from bobbin flange 26 and from the opposed upstanding bosses 28 thereon so as to project centrally up through the apertures 16 of corresponding arcuate shape in the solenoid housing 10 for connection to a suitable controlled source of electrical power, as desired. The opposite end of each such lead 29 is suitably connected, in a known manner, to a terminal end of the solenoid coil 18. Preferably, as shown in FIG. 1, each terminal lead 29 is provided at its upper enlarged diameter end, with a plurality of axial spaced apart annular grooves 29*a* for a purpose to be described in detail hereinafter.

Preferably, the axial extent of bobbin 17 is preselected relative to the internal axial extent of the body 11 portion of the solenoid housing between the lower surface of flange 12 and the shoulder 11*c* so that when the bobbin 17 is positioned in the solenoid housing 10, as shown in the Figures, an axial clearance will exist between the lower face of the bottom flange 27 of the bobbin 17 and the shoulder 11*c* of the solenoid housing 10, for a purpose to be described hereinafter.

Bobbin 17 is further supported within the solenoid housing 10 by means of an encapsulant member 30, made of a suitable encapsulant material, such as glass filled nylon, that includes a cylindrical portion 30*a* encircling the solenoid coil 18 and the outer peripheral edge of the lower flange 27 of the bobbin 17 and which is also in abutment against the inner surface of the upper portion 11*a* of body 11, a plurality of radial or axial extending bridge connectors 30*b* corresponding in number to the apertures 14 and 16, respectively, an outer cup-shaped outer shell 30*c* encircling the exterior upper portion 11*a* of body 11 and flange 12 of the solenoid body 10 and a pair of diametrically opposed studs 30*d*, each of which encloses a terminal lead 29. It will now be apparent that the bridge connectors 30*b* extending through apertures 14 and 16 and the material adjacent the lower ends of studs 30*d*, extending through associate apertures 16, serve to interconnect the portion 30*a* and shell 30*c* to each other. As shown, the encapsulant material of studs 30*d* extends into each of the annular grooves 29*a* of a terminal lead 29 to make it more securely fixed to the assembly.

Preferably, as shown in FIG. 1, the flange 27 of bobbin 17 is undercut at its lower outer peripheral edge to effect a lock with the cylindrical portion 30*a* of the encapsulant member 30 so as to further effect positive retention of the bobbin 17 within the solenoid housing 10. The encapsulant member 30 is molded in place whereby a fluid tight seal exists between the above described elements of the solenoid assembly.

The nozzle assembly 7 includes a nozzle body 32 of tubular configuration, having a circular upper portion 33, a circular intermediate portion 34 and a circular lower portion 35. Portions 34 and 35 are of successively reduced external diameters relative to the external diameter of upper portion 33. Portions 33 and 34 are interconnected by an external shoulder 36 and portions 34 and 35 are interconnected by an external shoulder 37.

The nozzle body 32 is fixed to the solenoid housing 10, with the outer edge portion of the flat upper surface 38 of the nozzle body 32 in abutment against shoulder 11*c*, as by inwardly crimping or swaging the lower end of body portion 11*b* at a location next adjacent to shoulder 36 to define a radially inward extending rim flange 11*d*. Since as previously described, the axial extent of bobbin 17 is preselected to provide an axial clearance between its lower surface and the shoulder 11*c*, the nozzle body 32 will abut against this shoulder. In addition, because of the increased rate of thermal expansion of the material of the bobbin relative to the material of the solenoid housing 10, a sufficient clearance is provided for this expansion so that the bobbin will not press against the nozzle body 32.

Nozzle body 32 is provided with a central through stepped bore to provide an internal circular upper wall 40 and a lower wall 41, which is of a greater internal diameter than that of wall 40 and which is provided at its lower end with internal threads 42. The walls 40 and 41 are interconnected by a flat shoulder 43.

In addition, the nozzle body 32 is provided with a plurality of circumferentially spaced apart radial ports 44 in the lower portion 35 which open into a fuel chamber 45 defined in part by the lower wall 41.

The nozzle assembly 7 further includes a valve seat element 46, a director plate 47 and a spray tip 48 with a seal ring 49 positioned between the valve seat element 46 and spray tip 48 in a manner to be described hereinafter.

Valve seat element 46 is provided with a flange 50 and with a reduced diameter body 51 depending therefrom, which is preferably tapered at its lower end, as shown, to effect its assembly into spray tip 48. A stepped central bore through the valve seat element 46 defines, in succession, starting from the top with reference to FIG. 1, an internal conical upper wall 52, an internal straight guide wall 53, an annular recess 54, a conical valve seat 55 and a lower wall defining a discharge passage 56.

The director plate 47 is provided with a plurality of circumferentially, equally spaced apart inclined and axial extending director passages 57. Preferably six such passages are used although only one such passage is shown in FIG. 1. These director passages 57, of predetermined equal diameters, extend at one end downward from the upward surface of the director plate 47 and are positioned so as to be located radially inward of the discharge passage 56 and the valve seat element 46.

The spray tip 48, of cup-shaped configuration, is provided with a circular internal upper wall 60 and a reduced diameter lower wall 61 that defines a passage for the discharge of fuel from the nozzle assembly. The walls 60 and 61 are interconnected by a flat shoulder 62.

As illustrated, the upper wall 61 of the spray tip 48 is of a suitable internal diameter whereby to slidably receive the wall portion 51 of the valve seat element 46 and to receive the director plate 47 so as to be sandwiched between the lower end surface of the valve seat element 46 and the internal shoulder 62 of the spray tip. As shown, the ring seal 49 is located so as to encircle the reduced diameter body 51 of the valve seat element 46 whereby it will be sandwiched between the valve seat element 46 and the internal wall 41 of the nozzle body 32.

In the construction shown, the outer peripheral surface of the spray tip 48 is provided with external threads 63 for mating engagement with the internal threads 42 of the nozzle body 32. Preferably these mating threads are of a suitable fine pitch whereby to limit axial movement of the spray tip a predetermined extent, as desired, for each full revolution of the spray tip 48 relative to the nozzle body 32.

The lower face of the spray tip 48 is provided, for example, with at least a pair of diametrically opposed blind bores 64 of a size so as to slidably receive the lug of a suitable spanner wrench, not shown. With this arrangement rotational torque may thus be applied to the spray tip 48 during assembly to and to effect axial adjustment of this element in the nozzle body 32.

As illustrated, a coil spring 65 is loosely positioned in the fuel chamber 45 whereby one end thereof abuts against the flange 50 of the valve seat element 46 so as to bias it into abutment against the spray tip 48 with the directory plate 47 sandwiched therebetween.

To effect filtering of the fuel being supplied to the injector 5 prior to its entry into the fuel chamber 45, there is provided a fuel filter assembly, generally designated 66. The fuel filter assembly 66 is adapted to be suitably secured, as by a suitable press fit, to the nozzle body 32 in position to encircle the radial ports 44.

Referring now to the armature valve member 8, this member, starting in succession from the top with reference to FIG. 1, includes an armature 70, an outward extending radial flange 71, a stud portion 72 and a valve 73. The armature 70 is of cylindrical configuration and of a predetermined outside diameter whereby it is loosely reciprocable in both the bobbin bore 25 and in the wall 40 of the bobbin 17 and nozzle body 32 respectively.

As shown, the valve 73 is of semi-spherical configuration and of a predetermined radius R, as seen in FIG. 1, whereby it is slidably received and guided by the guide wall 53 of the valve seat element 46 and whereby its spherical lower end defines a seating surface 74 for engagement with the valve seat 55. As illustrated, preferably two or more suitable flats 75 are provided on the outer peripheral side surface of the valve 73, that is about its horizontal center line with reference to FIG. 1, whereby each flat define a passage with the guide wall 63 for the flow of fuel. In the embodiment illustrated in both FIG. 1, and in FIG. 2, four such flats are provided on the valve 73 in circumferentially spaced apart relationship to each other.

To further effect axial guiding of the armature/valve member 8 during movement between a lowered position, as shown in FIG. 1, whereat valve 73 engages valve seat 55 and a raised position, there is provided a guide member, in the form of a guide washer 76 that is also positioned in the fuel chamber 45.

The guide washer 76 has a central aperture therethrough defining a straight internal guide wall 77 of a predetermined internal diameter relative to the outside diameter of the armature 70 so as to slidably receive this armature 70 portion of the armature/valve member 8 intermediate its ends. Suitable flats 78 are provided on the outer peripheral surface of the armature 70 at an axial location whereby to define with the guide wall 77 suitable passage for the flow of fuel. In the construction illustrated, three such flats 78 are provided on the armature 70, although only two are shown in FIG. 1. The outside diameter of the guide washer 76 is preselected relative to the internal diameter of the wall 41 of the nozzle body 32 so as to be loosely received therein.

As shown, the guide washer 76, as thus loosely received in wall 41 is held in abutment against the shoulder 43 of the nozzle body 32 by the coil spring 65 which has its opposite end in abutment against the guide washer.

With the arrangement shown, the armature/valve member 8 is guided at one end by the valve 73 slidable in the guide wall 53 of the valve seat element 46 and, intermediate its ends by the armature 70 in the guide wall 77 of guide washer 76 whereby it neither engages the internal wall defined by bore 25 in bobbin 17 nor the wall 40 in the nozzle body 32.

The armature/valve member 8 is normally biased in an axial direction, downward with reference to FIG. 1 to the position shown, so that the valve 73 is in seating engagement with valve seat 55 by means of a coil armature return spring 80 of predetermined force. Armature return spring 80 is positioned to loosely encircle armature 70 with one end thereof in abutment against the flange 71 of the armature/valve member 8 and its opposite end in abutment against the guide washer 76.

When the armature/valve member 8 is in its lowered position as shown in FIG. 1, a working air gap is established between the lower end of the pole piece 20 and the upper end of the armature 70 by axial positioning of the spray tip 48 in the nozzle body 32. However, in order to provide for a minimum fixed working air gap between the lower end of the pole piece 20 and the upper end of the armature 70 when in the raised position, a solenoid stop 81, in the form of a cylindrical plug of, for example, physically hard material, is fixed as by a press fit into the enlarged diameter end portion of a blind bore 82 that extends axially into pole piece 20 from the lower end. In the construction illustrated, the pole piece 20 in addition to the bore 82 is provided with an internal shoulder **82*a*** which serves as an abutment stop for one end of the solenoid stop.

The axial extent of the solenoid stop 81 is preselected relative to the axial extent of shoulder **82*a* so that the lower end of the solenoid stop 81 projects downward from the lower end of the pole piece 20 a predetermined distance. The lower end face of the solenoid stop 81 thus is operative to limit upward movement of armature 70 toward the lower working face of the pole piece 20** so as to establish a minimum fixed working air gap between the opposed working surfaces of the pole piece and armature.

Preferably, at least one of the opposed working contact surfaces of the pole piece or of the armature/-valve member is crowned, that is, it is formed with a suitable convex configuration, such as the contact end surface **81*a* at the lower free end of the solenoid stop 81, to allow the armature/valve member to operate with some level of centerline skewness with respect to the axis or centerline of the pole piece 20** without adversely affecting the stroke parameter of the armature/valve member or the hydraulic adherence (stiction) at the pole piece and armature/valve member interface.

Preselected surfaces of the armature/valve member are preferably made of a suitable wear resistant material with the remainder of at least the armature portion of this member being of magnetically soft material. For example, these preselected surfaces may be case hardened surfaces provided for in a manner similar to that disclosed in the above-identified U.S. Pat. No. 4,231,525. Thus with reference to the construction shown in FIG. 1, a small central disc like portion on the upper end of armature 70, the outer peripheral surface of the armature 70 between the flats 78 and the outer peripheral surface of valve 73 would be of such wear resistant material.

The guide washer 76 and valve seat element 46 are suitably sized relative to the internal diameter wall 41 in the nozzle body 32 so that each will have a degree of radial freedom of movement, that is, each is adapted to be relatively loosely received within the opening defined by bore wall 41. This then provides a degree of self alignment to the armature/valve member 8, wherein, these elements are, in effect, radially positioned by the armature/valve member at initial assembly. Thereafter, during axial position of the spray tip 48 to an operative position, as shown in FIG. 1 for example, the coil spring 65 will then be operative to apply a sufficient clamping force or pressure against both the guide washer 76 and the valve seat element 46 so as to fix these elements within the nozzle body 32 to effectively guide the armature/valve member during reciprocation thereof. These guide element provisions at, in effect, both ends of the armature/valve member 8 thus allows it to operate with some centerline skewness relative to the axis of the pole piece 20 and eliminates random radial movement of the armature/valve member during its operation.

Figure 2:
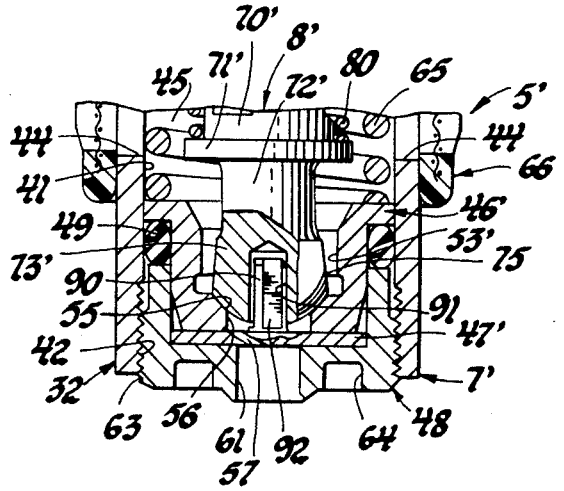

An alternate embodiment of an electromagnetic fuel injector, generally designated 5', in accordance with the invention is shown in FIG. 2 wherein similar parts are designated by similar numerals, but with the addition of a prime (') where appropriate.

The armature/valve member 8' in this alternate embodiment is guided adjacent to its upper end by a guide washer 76 which encircles the outer peripheral surface of the armature 70 portion thereof in the same manner as described with reference to the embodiment of FIG. 1.

However at its other end, the lower end with reference to FIG. 2, the armature/valve member 8' is axially guided for reciprocable movement by means of a guide pin or post 90 which extends loosely through the discharge passage 56 in the valve seat element 46' in position to be reciprocably received in an axial extending blind bored guide wall 91 provided in the bottom of the valve 73' portion of the armature/valve member 8'.

In the construction illustrated in FIG. 2, the guide post 90 is provided by means of a central upstanding boss provided on the director plate 47' and which is formed integral therewith. As shown, the director post 90 is positioned radially inward of the upper end openings of the director passages 57 in the director plate. Preferably, suitable means, such as one or more flats 92 formed in the guide post 90 define with the guide wall 91 fluid passages to prevent an hydraulic lock from occurring during relative reciprocation of the guide post 90 within the chamber defined by guide wall 91.

In view of the just described guide post 90 and guide wall 91 provision to effect axial guiding of the valve 73 end of the armature/valve member 8' during reciprocation thereof, the wall 53' of the valve seat element 46' in the embodiment of FIG. 2, is of a suitable internal diameter greater than the outside diameter of the valve 73' so that the valve 73' will be loosely reciprocable received therein.

With the external diameter of the director plate 47' being sized relative to the internal diameter of the wall 60 of the spray tip 48 so as to have a degree of radial freedom of movement therein, there is provided a degree of self alignment of the director plate 47' and, in particular, the guide post 90 thereon relative to both the armature/valve member 8' and to the valve seat 55 in the valve seat element 46'.

That is during assembly of the valve 73' end of the armature/valve member 8' into seating engagement against the valve seat 55 in the valve seat element 46' and with its guide bore wall 91 receiving the guide post 90 therein and with the guide washer 76 encircling the armature 70 end of the armature/valve member 8' these elements are, in effect, self aligned with respect to each other. Then as these elements are assembled into the nozzle body 32 and the spray tip 48 is torqued upward, with reference to FIG. 2, the spring 65 will apply a clamping force against both the guide washer 78 and to the director plate 47', as sandwiched between the valve seat element 46' and the spray tip 48, so as to fix the guide washer and director plate 47' in the thus armature/valve member 8' aligned positions within the nozzle body 32.

While the invention has been described with reference to particular embodiments disclosed herein, it is not confined to the details set forth since it is apparent that various modifications can be made by those skilled in the art without departing from the scope of the invention. This application is therefore intended to cover such modifications or changes as may come within the purposes of the invention as defined by the following claims.

The embodiments of the invention in which an exclusive property or privilege is claimed are defined as follows:

1. An electromagnetic fuel injector including a housing means defining a generally cylindrical stepped bore having an internally threaded enlarged diameter bore portion at one end thereof and defining an abutment shoulder intermediate its end; a spray tip means in said bore portion, said spray tip means including a spray tip adjustably threaded in said bore portion and a valve seat/director means slidably received in said bore portion and axially located in one direction by said spray tip, a solenoid pole piece means operatively positioned in the opposite end of said bore in said housing means, said valve seat/director means defining a valve guide means, a valve seat and a discharge passage therein; an armature having a semi-spherical valve at one end thereof operatively positioned in said bore for movement in valve opening and closing directions relative to said valve seat with said valve being reciprocably guided by said valve guide means; said solenoid pole piece means including a solenoid coil to effect movement of said armature in one direction upon energization of said coil; a guide washer guidingly encircling said armature intermediate its ends and being slidably received in said bore portion so as to abut against said abutment shoulder; a valve spring operatively positioned for normally biasing said valve into engagement with said valve seat; and, a spring means positioned in said bore between said valve seat/director means and said guide washer whereby to apply a bias force so as to operatively fix them within said housing means as aligned by said armature means whereby they are then operative to serve as a guide for said armature during reciprocating movement thereof.

2. An electromagnetic fuel injector including a housing means defining a generally cylindrical stepped bore having an internally threaded enlarged diameter bore portion at one end thereof and defining an abutment shoulder intermediate its end; a spray tip means in said bore portion, said spray tip means including a spray tip adjustably threaded in said bore portion and a valve seat/director means slidably received in said bore portion and axially located in one direction by said spray tip, a solenoid pole piece means operatively positioned in the opposite end of said bore in said housing means, said valve seat/director means defining an internal annular valve guide wall, a discharge passage and an annular valve seat encircling said discharge passage; an armature having a semi-spherical valve at one end thereof operatively positioned in said bore for movement in valve opening and closing directions relative to said valve seat with said valve being reciprocably guided by said valve guide wall; said solenoid pole piece means including a solenoid coil to effect movement of said armature in one direction upon energization of said coil; means associated with said valve and said valve guide wall defining axial flow passages therebetween; a guide washer guidingly encircling said armature intermediate its ends and being slidably received in said bore portion so as to abut against said abutment shoulder; a valve spring operatively positioned for normally biasing said valve into engagement with said valve seat; and, a spring means positioned in said bore between said valve seat/director means and said guide washer whereby to apply a bias force so as to operatively fix them within said housing means as aligned by said armature means whereby they are then operative to serve as a guide for said armature during reciprocating movement thereof.

3. An electromagnetic fuel injector including a housing means defining a generally cylindrical stepped bore having an internally threaded enlarged diameter bore portion at one end thereof and defining an abutment shoulder intermediate its end; a spray tip means defining a discharge passage means positioned in said bore portion, said spray tip means including a spray tip adjustably threaded in said bore portion and a valve seat and director means slidably received in said bore portion and axially located in one direction by said spray tip, a solenoid pole piece means operatively positioned in the opposite end of said bore in said housing means, said valve seat and director means defining a guide pin with an annular valve seat encircling said guide pin; an armature means having at one end a semi-spherical valve with an axial guide bore therein operatively positioned in said bore for movement in valve opening and closing directions relative to said valve seat with said valve being reciprocably guided by sliding engagement of said guide pin in said guide bore; said solenoid pole piece means including a solenoid coil to effect movement of said armature means upon energization of said coil; a guide washer grindingly encircling said armature intermediate its ends and being slidably received in said bore portion so as to abut against said abutment shoulder; and, a spring means positioned in said bore between said valve seat and director means and said guide washer whereby to apply a bias force so as to operatively fix them within said housing means as aligned by said armature means whereby they are then operative to guide said armature means during reciprocating movement thereof.

* * * * *

UNITED STATES PATENT AND TRADEMARK OFFICE

CERTIFICATE OF CORRECTION

PATENT NO. : 4,423,842

DATED : January 3, 1984

INVENTOR(S) : James D. Palma

It is certified that error appears in the above—identified patent and that said Letters Patent is hereby corrected as shown below:

Column 10, line 58, "grindingly" should read -- guidingly --.

Signed and Sealed this

*Twenty-third* Day of *October 1984*

[SEAL]

*Attest:*

GERALD J. MOSSINGHOFF

*Attesting Officer*

*Commissioner of Patents and Trademarks*